US006443818B1

(12) United States Patent
Bent

(10) Patent No.: US 6,443,818 B1
(45) Date of Patent: Sep. 3, 2002

(54) GRINDING MACHINE

(75) Inventor: Russell Graham Bent, Bedfordshire (GB)

(73) Assignee: Unova U.K. Limited, Aylesbury (GB)

( * ) Notice: Subject to any disclaimer, the term of this patent is extended or adjusted under 35 U.S.C. 154(b) by 0 days.

(21) Appl. No.: 09/554,416

(22) PCT Filed: Nov. 12, 1998

(86) PCT No.: PCT/GB98/03265

§ 371 (c)(1),
(2), (4) Date: Jul. 10, 2000

(87) PCT Pub. No.: WO99/28081

PCT Pub. Date: Jun. 10, 1999

(30) Foreign Application Priority Data

Nov. 29, 1997 (GB) ..... 97252035

(51) Int. Cl.[7] ..... B24B 7/00

(52) U.S. Cl. ..... 451/177; 451/5; 451/6; 451/9; 451/11; 451/178

(58) Field of Search ..... 451/5, 6, 9, 11, 451/177, 178

(56) References Cited

U.S. PATENT DOCUMENTS 4,606,150 A * 8/1986 Grimm ..... 451/150
4,858,387 A * 8/1989 Clough et al. ..... 451/152
5,018,309 A * 5/1991 Wyss ..... 451/178
5,573,443 A * 11/1996 Yasuda et al. ..... 451/11

FOREIGN PATENT DOCUMENTS

JP 63-191559 * 9/1988 ..... B24B/5/14

* cited by examiner

*Primary Examiner*—Joseph J. Hail, III
*Assistant Examiner*—Shantese McDonald
(74) *Attorney, Agent, or Firm*—Lee, Mann, Smith, McWilliams, Sweeney & Ohlson

(57) ABSTRACT

A grinding machine, in particular a face grinder for grinding the faces of silicon wafers, has a grinding wheel spindle (20) and a work spindle (22) which are mounted so as to be pivotal about axes (A and B) respectively, each axis being perpendicular to the rotational axis of its respective spindle and being orthogonal to the rotation axis of the other spindle. Three sensors or probes (1 to 3) are provided to measure the position of one spindle relative to the other and to generate signals for controlling servo motors (26, 28) for adjusting the angular orientation of each spindle about its pivotal axis.

17 Claims, 3 Drawing Sheets

GRINDING MACHINE

FIELD OF INVENTION

This invention concerns grinding machines and in particular a mechanism for controlling wheel infeed in dependence on angular orientation between work spindle and wheel spindle axes.

BACKGROUND OF THE INVENTION

The angular relationship between two such spindles can be affected by forces produced by grinding, particularly during face grinding, and this can introduce inaccuracies in the grinding process.

In JP-A-63191559 there is disclosed a grinding machine in which a grinding wheel is mounted on a spindle which is also pivotally mounted perpendicular to its axis. A detector measures any deflection of the spindle and emits a control signal for correcting such deflection via a piezoelectric element.

U.S. Pat. No. 5573443 discloses a tool spindle arrangement for a grinding process in which the inclination of a ground workpiece is measured by a device, and the angle of the spindle axis is adjusted in response to a signal from the device.

OBJECT OF THE INVENTION

It is an object of the present invention to provide a means to control precisely the angular orientation between two such spindle axes, so as to set and maintain the desired angular relationship between the two spindles and thereby increase the accuracy of the subsequent grinding process.

SUMMARY OF THE INVENTION

According to the present invention there is provided a grinding machine comprising a workpiece spindle, a grinding wheel spindle, first mounting means for mounting one of the spindles for pivotal movement about a first axis which is perpendicular to the rotational axis of said one spindle, a first servo motor operable to position said one spindle about the first axis, characterised by sensors capable measuring distance which enable the position of said one spindle to be accurately determined relative to the other spindle by generating control signals for controlling the first servo motor.

Advantageously the machine may further comprise second mounting means for mounting either one of the spindles for pivotal movement about a second axis which is orthogonal to the first axis, and a second servo motor operable to position said either one of the spindles about the second axis, said sensors likewise controlling the second servo motor.

The second mounting means and the second servo motor may then be provided on the other spindle.

Preferably displacement sensors are employed.

Preferably the information obtained from the sensors is such as to allow the angle between the two spindles to be accurately determined.

The sensors may be positioned at three discrete points with respect to the spindles.

The measurements at the three discrete points are preferably made continuously; alternatively they may be made on a repetitive basis.

Measurements may be made at more than three positions.

It is possible to use relative changes in the measurements to calculate a change in angle between the two spindles and thereby allow the control signals to be computed for adjusting one or both of the servo motors to compensate for the movement which has been detected and reposition the spindle axis so as to maintain the desired relationship between the two spindle axes.

Angular movement of either spindle about its axis can be used to derive the change in linear distance between the two spindles resulting from the angular movement, and wheel feed control signals can be adjusted or corrected to compensate for any noted linear movement between the two spindles so as thereby to control precisely the infeed position between wheel spindle and work spindle.

In one arrangement each spindle assembly is supported in trunnion bearings mounted within a support so as to be pivotable about one of the said two orthogonal axes.

In an alternative arrangement each spindle assembly is supported by flexures which respectively define one of the two orthogonal axes about which the spindles pivot.

One of the orthogonal pivoting axes may be vertical and the other horizontal.

According to another aspect of the invention there is provided a face grinding machine in which a grinding spindle and a workpiece spindle are carried by respective housings, the workpiece and wheel spindle axes being parallel, characterised in that three probes are mounted for determining the distance between the two housings, each probe having associated therewith a sensor for generating a signal indicative of the distance between the two housings at the positions of the probes, and further comprising a servo motor responsive to the signals generated by the sensors for positioning one spindle relative to the other spindle.

Distance proportional signals may be digitised and the resulting digital signals are supplied to digital computing means programmed to compute from the digital signals the relative angular movement if any, between the two spindles as indicated by the signals from the probes, and to generate control signals for adjusting the servo motor associated with one or both of the two spindles to correct for any angular displacement detected, and further programmed to compute from the digital information from the sensors and/or from the control signals derived there from for controlling the servo motor or motors, correcting signals for adjustment of the wheelfeed control signals for adjusting the indeed position between wheel spindle and work spindle to compensate for any shift in the relative position of the two spindles.

The signals from the sensors need not necessarily be digital, and could instead be analogue signals, with appropriate gain modifiers.

BRIEF DESCRIPTION OF THE DRAWINGS

An embodiment of the invention is illustrated, by way of example only, in the accompanying drawings in which.

Figure 1:
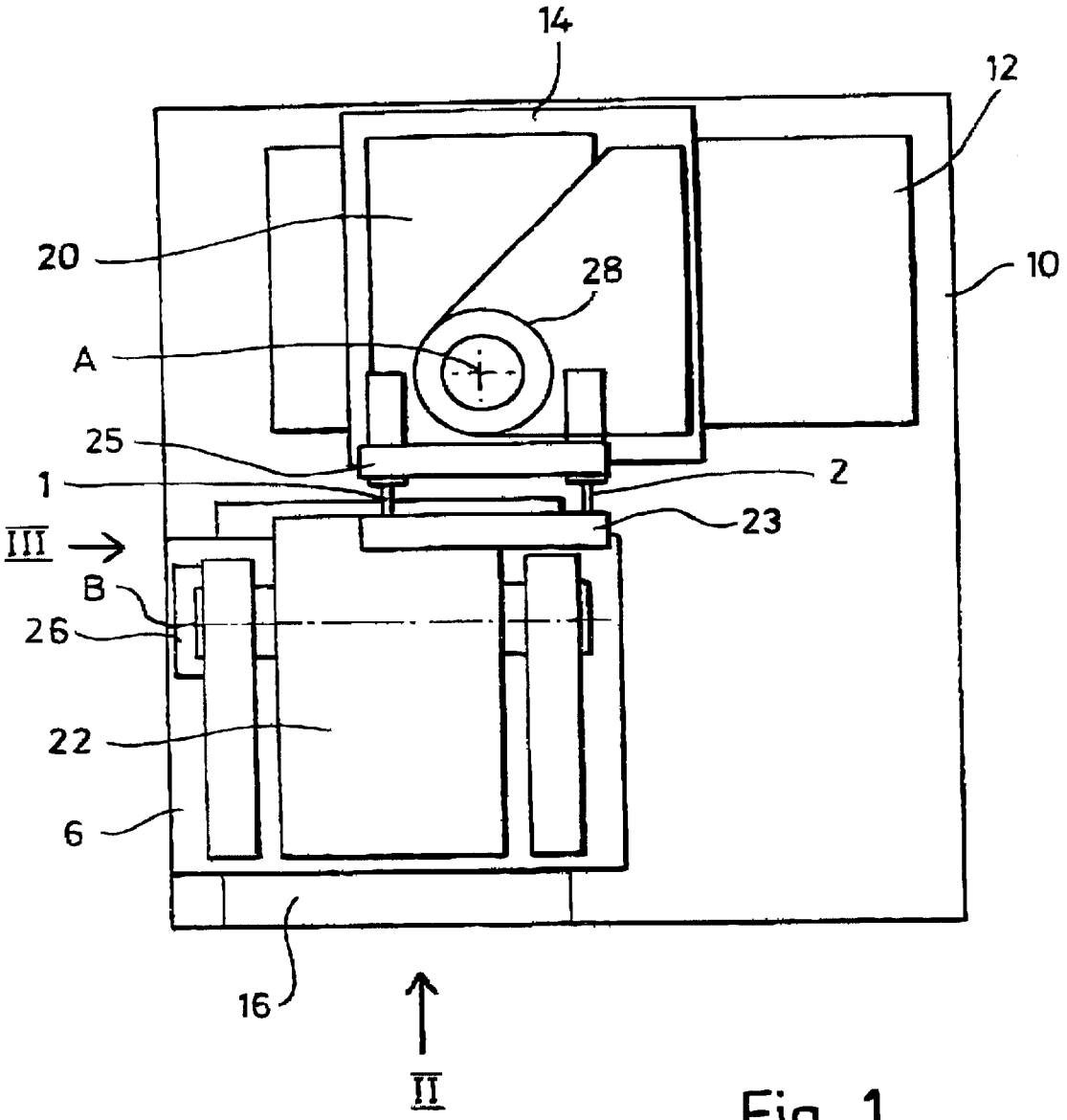
FIG. 1 is a plan view of a face grinding machine.

The viewing directions are shown by the arrows II and III in FIG. 1.

DETAILED DESCRIPTION OF EMBODIMENT

Referring to FIG. 1, the grinding machine comprises a base 10, a track 12 along which a grinding spindle support 14 can slide and a track 16 along which a support 6 for a workpiece spindle can slide. The grinding spindle assembly is shown at 20 and the work spindle assembly at 22, and the pivoting axis of the grinding spindle is shown at axis A and the orthogonal axis about which the work spindle can pivot is shown at B.

Figure 2:
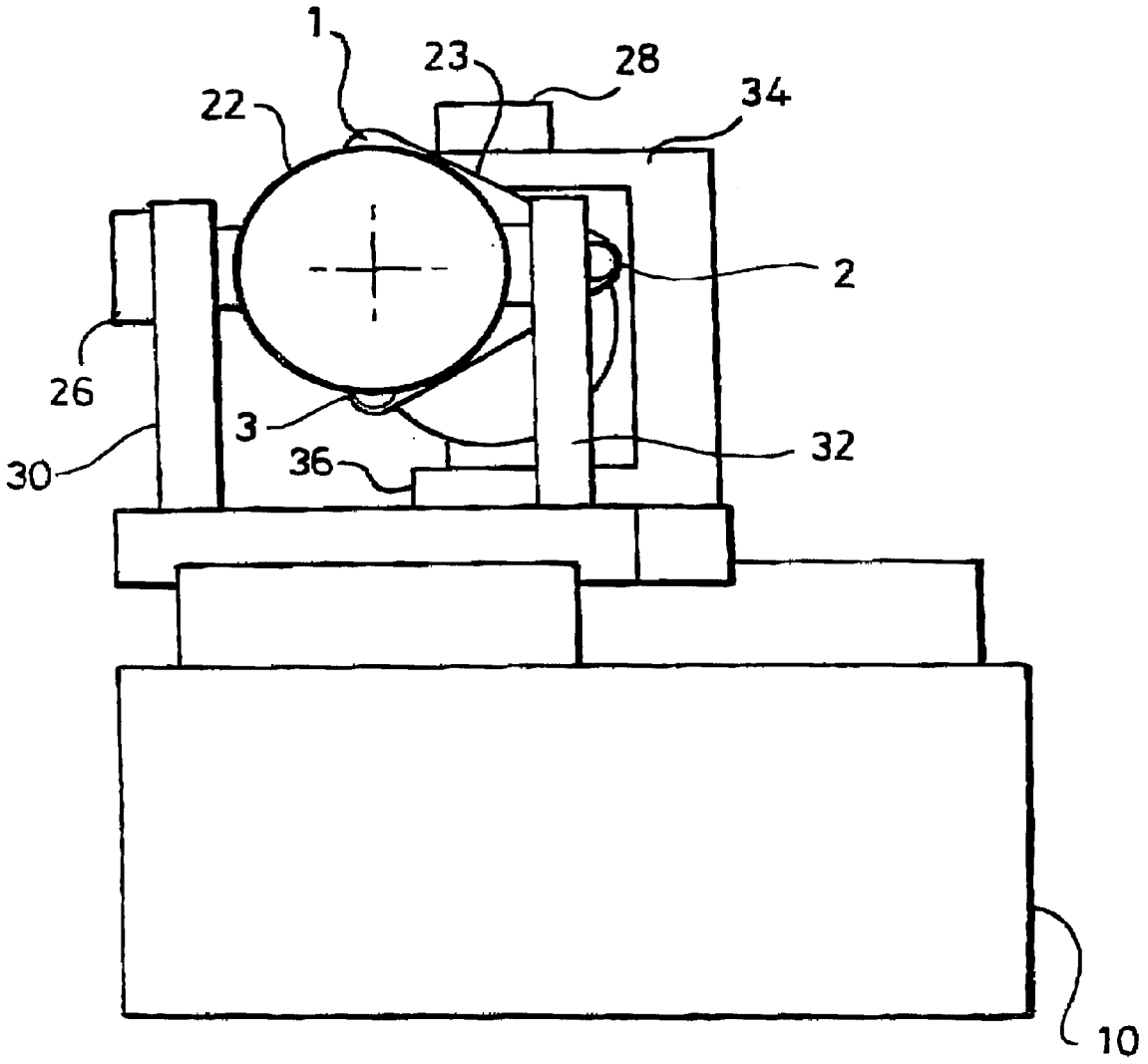
FIG. 2 is an end view of the machine shown in FIG. 1.

Three probes, each incorporating a sensor, are shown in the drawings. Probes 1 and 2 can be seen in FIG. 1, and probe 3 which is hidden by probe 1 in the plan view in FIG. 1 can be seen in FIGS. 2 and 3.

The three probes 1, 2 and 3 are respectively mounted at the corners of a triangular bracket 23 secured to the body of the work spindle 22, and they act against anvils (not shown) mounted on a corresponding bracket 25 secured to the body of the grinding spindle 20. However, the probes may alternatively be mounted on the bracket 25, and vice versa the anvils are mounted on the bracket 23.

The probes lie outside the rotation zone of both the work wheel and the cup grinding wheel (not shown). They may be of any type capable of measuring distance and providing an electric signal output, eg linear displacement probe, capacitive gauge, inductive gauge, air gauge, Linear Variable Differential Transformer (LVDT), or laser interferometer. In the example shown, the probes are linear displacement probes containing glass scale encoders. A preferred proprietary probe is the Certo (RTM) range type C6OM made by Dr Johannes Heidenhain GmbH of D-83301 Traunreut, Germany.

Figure 3:
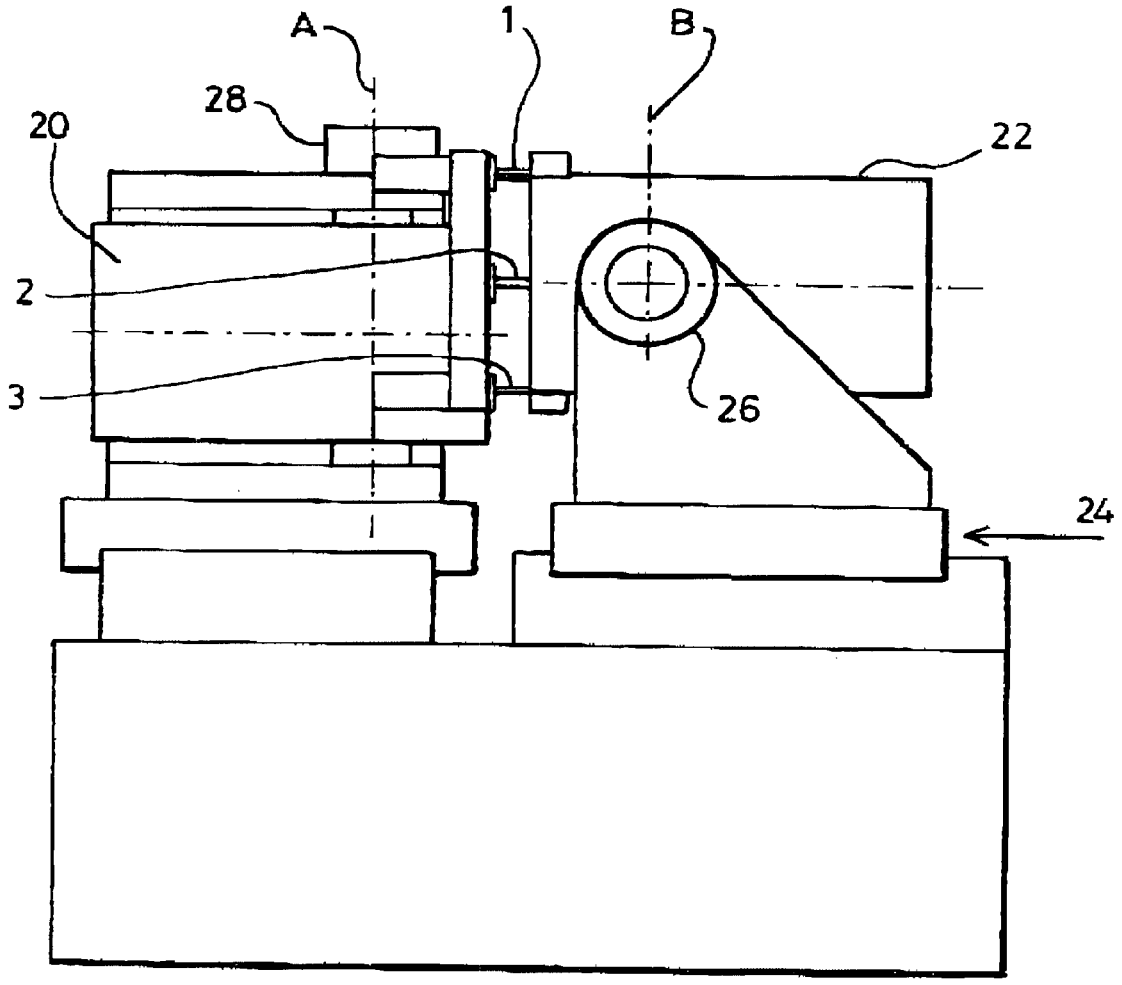
FIG. 3 is a side view thereof.

The infeed axis is identified in FIG. 3 at 24.

A servo motor for adjusting the work spindle assembly about axis B is denoted by 26 and a servo motor for adjusting the grinding spindle assembly about axis A is shown at 28.

However, any of a variety of actuators or prime movers may be utilised in place of servo motors.

The control electronics is not shown in detail, nor is the control for the motors associated with the grinding and work spindles contained within the assemblies 20 and 22.

Axes A and B are defined by stub-shafts extending from either side of the assemblies 20 and 22 respectively and which are carried in aligned bearings (not shown) fitted into the upper ends of support members 30 and 32 in the case of axis B, and into support numbers 34 and 36 in the case of axis A. Linear ball screws providing lever-actuation about pivots, usually stub-shafts on bearings may be used.

In the example shown, axis A is vertical and axis B is horizontal.

Furthermore, in the example shown, probes 1 and 3 are mounted vertically above and below the axis of the work spindle and probe 2 is mounted midway between the two probes 1 and 3 but displaced in a horizontal plane containing the axis of the work spindle.

In use, the servo motors 26 and 28 move their respective assemblies about the axes A and B in order to maintain the signal from each probe at a constant value. Thus the movement about axis B is controlled by the difference in the output signals between probe 1 and probe 2, while the movement about the axis A is controlled by the difference in the output signal between probe 2 and that of the average of probes 1 and 3. The linear infeed of the cup grinding wheel is controlled by the average of all three probes.

Where the probes are not symmetrically disposed around the wheel, each probe reading has to be adjusted by a gain modifier.

In the illustrated embodiment, either spindle could be the grinding spindle, the other in each case being the work spindle.

In a modified arrangement (not shown) one of the spindles may be fixed, while the other spindle is supported within a double gimbal device so as to be able to be pivoted by respective servo motors about the two orthogonal axes.

Furthermore, in some applications the machine may be arranged to be relatively stiff about one of the orthogonal axes, so that angular errors or inaccuracies only require to be corrected in the other axis. In such cases it may be sufficient for one of the spindles to be pivoted only about such other axis, and for the other spindle to be relatively fixed.

The servo motor may be replaced, for example by on-axis servo motors, off-axis servo motors through gears, ball screws, hydrostatic screws, air cylinders, hydraulic drives, linear motors, piezo stacks, poisson-pushers or thermal displacement drives.

The pivot axes may, for example be real, flexured, or generated by means of two linears and a rotary, or by tripod or hexapod legs, or any combination thereof.

A particular application of the present invention is in the grinding of the faces of silicon wafers.

It will be appreciated that in a conventional arrangement even a small change in angle between the spindle axes of the grinding wheel and the workpiece component results in the component face being ground incorrectly, either slightly in a conical form or conversely in a slightly "gothic arch" form, or a combination of the two forms. Since all grinding machines inherently have a compliance between the wheel and the component, the resulting change in angle between axes, if uncorrected, must inevitably produce such a form error. However, by measuring this change in angle in accordance with the invention, as above described, and using this measurement to control the correction of the angle, so the form error can at least be significantly reduced. Such reduction in error is limited only by the accuracy of measurement and by the band-width of the control loop, and is independent of the stiffness of the machine.

What is claimed is:

1. A grinding machine comprising a workpiece spindle and a grinding wheel spindle, each spindle being rotatable about a respective rotational axis, first mounting means for mounting one of the spindles for pivotal movement about a first axis which is perpendicular to the rotational axis of said one spindle, a first servo motor operable to position said one spindle about the first axis, and including sensors, capable of measuring distance, which are positioned at three discrete points with respect to the spindles, and which enable the position of said one spindle to be accurately determined relative to the other spindle by generating control signals for controlling the first servo motor.

2. A machine as claimed in claim 1 further comprising second mounting means for mounting either one of the spindles (20, 22) for pivotal movement about a second axis (B) which is orthogonal to the first axis, and a second servo motor (28 or 26) operable to position said either one of the spindles about the second axis, said sensors likewise controlling the second servo motor.

3. A machine as claimed in claim 2 in which the second mounting means and the second servo motor are provided on said other spindle.

4. A machine as claimed in claim 2, in which the two spindles are at an angle to one another, and in which the sensors provide information which allows the angle between the two spindles to be accurately determined.

5. A machine as claimed in claim 4 in which relative changes in the measurements are employed to calculate a change in said angle between the two spindles whereby control signals are computed for adjusting one or both of said servo motors to compensate for any movement which has been detected, and to reposition the spindle axis so as to maintain the desired relationship between the two spindle axes.

6. A machine as claimed in claim 2 in which angular movement of either one of the two spindles about its respective axis is employed to derive the change in the near distance between the two spindles resulting from the angular movement, and in which grinding wheel feed control signals are adjusted or corrected to compensate for any noted linear movement between the two spindles so as thereby to control precisely the said position between the two spindles.

7. A machine as claimed in claim 2 in which each of said first and second mounting means comprises a trunnion bearing mounted within a support so as to be pivotable about the respective first or second axes.

8. A machine as claimed in claim 2, in which said first and second mounting means comprise flexures which respectively define said first and second axes.

9. A machine as claimed in claim 1 in which the sensors are displacement sensors.

10. A machine as claimed in claim 1 in which continuous measurements are made at the three discrete points.

11. A machine as claimed in claim 1 in which the measurements at the three discrete points are made on a repetitive basis.

12. A machine as claimed in claim 1 in which the first axis (A) is vertical, and the second axis (B) is horizontal.

13. A face grinding machine in which a grinding wheel spindle and a workpiece spindle are carried by respective housings, the workpiece and wheel spindle axes being parallel, and in which probes are mounted for determining the distance between the two housings, each probe having associated therewith a sensor which is positioned at a discrete point with respect to its associated probe for generating a signal indicative of the distance between the two housings at the respective probe, and further comprising a servo motor responsive to signals generated by the sensors for positioning one spindle relative to the other spindle.

14. A machine as claimed in claim 13 in which each said signal indicative of said distance is digitised and the resulting digital signals are supplied to digital computing means programmed to compute from said digital signals any relative angular movement between the two spindles, to generate control signals adapted to adjust a servo motor associated with at least one of said housings for correcting said angular movement, and to compute from at least one of said digital signals and said control signals derived there from, correcting signals for adjustment to the wheelfeed control signals adapted to compensate for any shift in the relative positioning of the two spindles.

15. A machine as claimed in claim 13 in which said signals from sensors are analogue signals and appropriate gain modifiers are provided.

16. A machine as claimed in claim 13 in combination with signal processing and computing means for processing signals generated by sensors to produce process signals for controlling said servo motor, thereby to reduce errors during grinding due to angular misalignment of the spindles.

17. A machine as claimed in claim 16 in which the grinding wheel spindle is moved relative to the workpiece spindle by feed control signals, and said processed signals additionally adjust said control signals.

* * * * *